313-414 SR
6/17/80 OR 4,208,610

United States Patent [19]
Schwartz
[11] 4,208,610
[45] Jun. 17, 1980

[54] TELEVISION PICTURE TUBES HAVING AN ELECTRON GUN WITH APERTURE ELECTRODE SHIELDING MEANS

[75] Inventor: James W. Schwartz, Deerfield, Ill.

[73] Assignee: Zenith Radio Corporation, Glenview, Ill.

[21] Appl. No.: 913,985

[22] Filed: Jun. 9, 1978

[51] Int. Cl.[2] ..... H01J 29/50; H01J 29/56
[52] U.S. Cl. ..... 313/414; 313/458
[58] Field of Search ..... 313/411, 412, 413, 414, 313/417, 409 (U.S. only), 309

[56] References Cited

U.S. PATENT DOCUMENTS

| | | | |
|---|---|---|---|
| 3,771,002 | 11/1973 | Standaart | 313/411 |
| 3,772,554 | 11/1973 | Hughes | 313/414 |
| 4,086,513 | 4/1978 | Evans | 313/414 |

*Primary Examiner*—Robert Segal
*Attorney, Agent, or Firm*—Ralph E. Clarke, Jr.

[57] ABSTRACT

This disclosure depicts a television cathode ray picture tube having a plural-beam electron gun for projecting in superimposition on the picture imaging screen of the tube at least two electron beam spots. The gun includes at least one aperture electrode having an aperture for passage therethrough of each of said beams. The beams are subject to a first-order aberration attributable to the aperture electrode resulting in the astigmatizing, and consequent distortion of, the beam spots. This astigmatizing is due to the coalescing of electric field vectors contiguous to each aperture with the vectors of at least one adjacent aperture. The improvement comprises shielding means interposed between the apertures comprising wall means. The wall means are effective to mutually shield the apertures and isolate the electric field vectors to ameliorate the first order aberration. The wall means introduces, however, higher-order aberrations due to a disordering of the electric field vectors resulting in forms of beam spot distortion other than astigmatic. The improvement further comprises a configuration of the wall means wherein a section of the wall means comprises a cut-out. The cut-out is shaped so as to be effective to re-order the vectors and ameliorate the effect of the higher order aberrations. As a result, the electron gun having aperture electrodes is enabled to project substantially undistorted beam spots.

3 Claims, 16 Drawing Figures

TELEVISION PICTURE TUBES HAVING AN ELECTRON GUN WITH APERTURE ELECTRODE SHIELDING MEANS

BACKGROUND OF THE INVENTION AND PRIOR ART STATEMENT

This invention relates generally to improved unitized in-line and delta-type configured electron guns for color cathode ray picture tubes, and is specifically addressed to an improved aperture electrode structure for such guns that provides enhanced picture resolution.

Electron guns in color cathode ray picture tubes commonly generate three electron beams developed by cathodic thermionic emission. The beams are formed and shaped by a tandem succession of electrodes spaced along the central axis of the gun. The electrodes cause the beams to be focused on multiple phosphor groups located on the faceplate of a tube. A prime objective in the design of such guns is to provide a relatively small beam spot size for enhanced picture resolution.

A serious problem arises in the design and construction of electron guns, especially unitized, in-line guns enclosed in the widely used narrow-neck tubes—a problem resulting from the fact that the electron beams must travel in close proximity because of the space restrictions of the narrow confines of the neck of the cathode ray tube in which guns lie. For example, the three beams of an in-line unitized gun are commonly about one-quarter of an inch apart. As a result of this propinquity, electric field vectors contiguous to adjacent beam apertures tend to coalesce or otherwise interact to exert an undesired effect on the contours of the beams. This "cross talk" can result in deforming the beams so that the beam spots become elliptical at their respective points of landing on the picture imaging plane of the faceplate. This ellipticity can be compensated for in some measure, but at the cost of an undesired increase in spot size and consequent reduction in resolution.

The problem of interaction of the fields contiguous to apertures of adjacent beams is particularly acute in what is commonly termed "the aperture electrode." The aperture electrode is essentially a flat sheet suitably apertured to form an electrode. As shown in FIG. 1, an aperture electrode for a three-beam unitized, in-line gun, for example, may comprise a thin, substantially rectangular member 2 having apertures 4 therein for passage of beams 6. Aperture electrodes may have strengthening flanges 8 to prevent distortion of the planar surface. In a delta-configured gun, an aperture electrode may comprise a thin, suitably apertured disc, as shown by FIG. 2. It should be noted that the aperture electrodes shown by FIGS. 1 and 2 are displayed in simplest schematic form without appurtenances such as support tabs for attachment to supporting multiforms.

Aperture electrodes are attractive in that they cost less to manufacture than the commonly used "cylinder" electrode which, as the name connotes, comprises one or more beam-passing tubes, or cylinders. Also, aperture electrodes offer an electro-optical benefit in that an aperture in such an electrode produces a lens which appears to the beam passing therethrough to be of larger diameter than the lens produced by the beam-passing aperture of a cylinder electrode.

However, these benefits are largely offset by the fact that the electric field vectors of aperture electrodes contiguous to each aperure tend to coalesce with the electric field vectors of at least one adjacent aperture to produce a form of aberration known as astigmatism. Astigmatism is a focus defect in which electrons in different axial planes come to focus at different points on the picture imaging plane, resulting in distortion of the beam spot. More particularly in the context of this disclosure, astigmatism is defined as a focus defect in which electrons lying in a plane passing through the axes of coplanar adjacent apertures will, in general, come to focus at a different point than electrons lying the same distance from the axes, but lying in planes transverse to the first plane. In the case of aperture electrodes, distortion to astigmatism manifests itself as a pronounced spot ellipticity at the beam landing point on the picture imaging plane.

The use of aperture electrodes in the prior art has been restricted primarily to single-beam electron guns because of the aforedescribed astigmatism problem. In an attempt to alleviate aberration in aperture lenses, apertures have been formed with tubular projections extending therefrom. However, depending upon the length of the tubular projections, such structures tend to lose the electro-optical benefit of the true aperture electrode in that they become, in effect, cylinder electrodes.

The use of aperture electrodes in a three-beam unitized electron is disclosed in U.S. Pat. No. 3,772,554—Hughes. The electrodes comprise the control and screen grid electrodes located in the prefocus section of a gun having a bi-potential main focus lens. Beam aberration normally attributable to aperture electrodes does not appear to be a problem because the aperture electrodes are located in the "low-level" zone of the gun where beam aberrating influences are minimal. Also, the very small size of the apertures results in beams of such small diameter in the prefocus section that there appears to be no appreciable coalescing of electric field vectors.

Attempts to use aperture electrodes in other zones of the electron gun, such as the main focus lens section, have resulted in the introduction of unacceptable beam distortion—a problem to which this present invention is addressed.

In U.S. Pat. No. 4,086,513, Evans discloses means which are said to at least partially compensate for the horizontal elongation of electron beam spots due to deflection defocusing effects of certain seld-converging yokes. According to Evans, this problem is present in television picture tubes having wide deflection angles; e.g., 90°–110 of deflection. One embodiment according to Evans provides horizontal parallel plates positioned on opposite sides of each beam and extending towards the screen from one of the focusing electrodes. The plates provide for a pre-distortion, or a pre-shaping, of the beams which is alleged to be effective to provide sufficient astigmatism in the electron gun so that a focus voltage can be obtained that provides optimum focusing of the electron beam in both the vertical and horizontal directions. Another embodiment of the invention provides for strengthening the focusing field about a horizontal axis by the placement of vertically oriented plates on opposite sides of each aperture of an accelerating and focusing eletrode.

OBJECTS OF THE INVENTION

It is a general object of this invention to provide means for enhancing resolution of color cathode ray picture tubes.

It is another general object to make feasible the use of aperture electrodes in unitized electron guns.

It is a more specific object to provide improved inter-aperture shielding means for aperture electrodes.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

FIG. 6A is an end view of the electrode of FIG. 6 showing a configuration of the shielding means, while

FIG. 7A is an end view of the electrode of FIG. 7 showing additional details of the provision, while

DESCRIPTION OF THE PREFERRED EMBODIMENT

Figure 1:
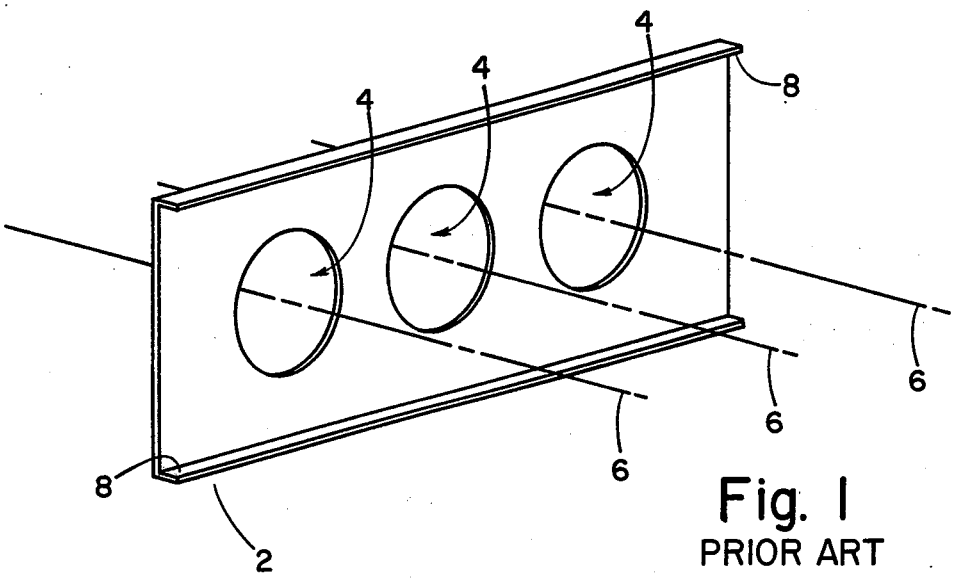
Fig. 1 PRIOR ART
FIG. 1 is a view in perspective of an aperture electrode for use in a three-beam unitized, in-line electron gun.
Figure 2:
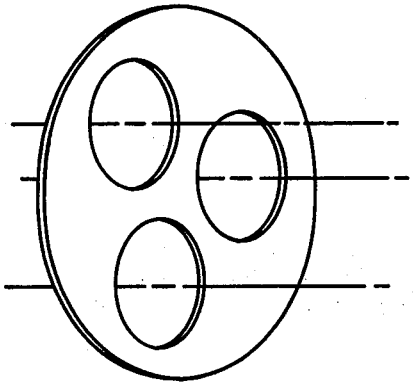
Fig. 2 PRIOR ART
FIG. 2 is a view in perspective of an aperture electrode for use in a delta-configured electron gun.
Figure 3:
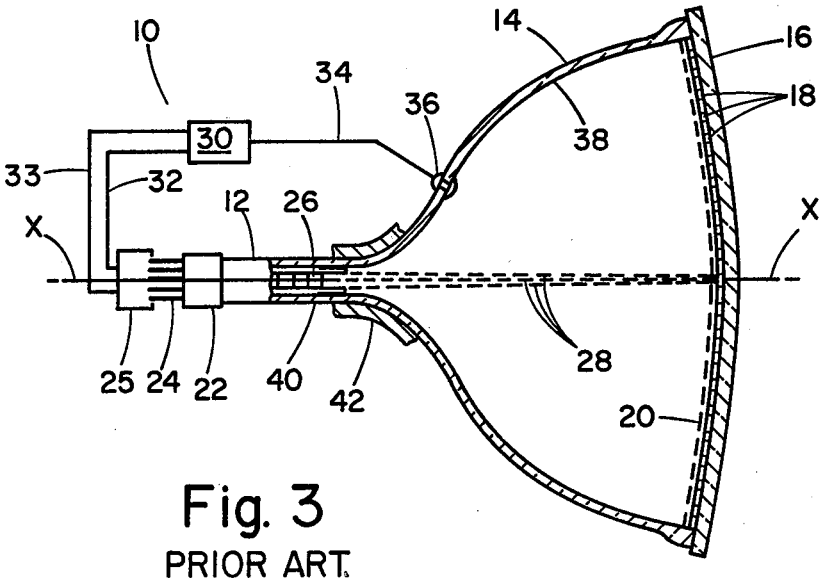
Fig. 3 PRIOR ART.
FIG. 3 is a schematic top view in longitudinal cross-section of a television picture tube in which the invention may be advantageously employed.

FIG. 3 shows a color television picture tube wherein the invention may be advantageously employed. The primary components of the color picture tube 10 depicted, which may be considered as typical of the art, comprise an evacuated envelope including a neck 12, a funnel 14 and a faceplate 16. On the inner surface of the faceplate 16 are deposited a multiplicity of cathodoluminescent phosphor target elements 19 comprising a pattern of groups of red-light-emitting, green-light-emitting, and blue-light-emitting dots or stripes. A foraminated electrode 20 commonly termed a shadow mask is used for color selection. Base 22 provides entrance means for a plurality of electrically conductive lead-in pins 24.

An electron gun 26, illustrated schematically, is disposed within neck 12 substantially as shown. Gun 26 is commonly installed in axial alignment with a center line X—X of picture tube 10. Electron gun 26 emits three electron beams 28 to selectively activate discrete phosphor target elements 18, as is well-known in the art. Electron gun 26 may be the three-beam, unitized in-line type, or, a gun of delta configuration. Electron gun 26 includes at least one aperture electrode having shielding means according to the invention.

Power supply 30, also shown schematically, provides voltages for operation of the cathode ray picture tube and its associated electron gun. Power supply 30 may supply relatively low voltages in the one to eight kilovolts range through one or more leads represented schematically by 32, which enter the envelope of tube 10 through ones of the plurality of lead-in pins 24 in base 22 electrically connected to tube socket 25. Power supply 30 may also supply selected intermediate voltages to the focus electrodes of electron gun 26, voltages typically in the range of eight to fifteen kilovolts or higher. These voltages are shown as being supplied to the electrodes within the envelope of tube 12 by way of ones of lead-in pins 24 through lead 33. The relatively high voltage for electron gun operation; that is, a voltage typically in the range of twenty-four to thirty-two kilovolts for excitation of the main focusing lens of the electron gun, is indirectly supplied to gun 26 through lead 34, which is connected to anode button 36. Anode button 36 in turn introduces the high voltage through the glass funnel 14, making internal contact with a thin, electrically conductive coating 38 disposed on the internal surface of funnel 14 and part-way into neck 12. The final electrode of gun 26; that is, the anode electrode comprising part of the main focusing lens, receives the relatively high voltage of electrically conductive coating 38 through a plurality of outwardly extending metallic springs 40 attached to the final electrode and which are in electrically contact with inner conductive coating 38. Yoke 42, in conjunction with associated electronic scanning circuits, provides for the scanning of beams 28.

Figure 4:
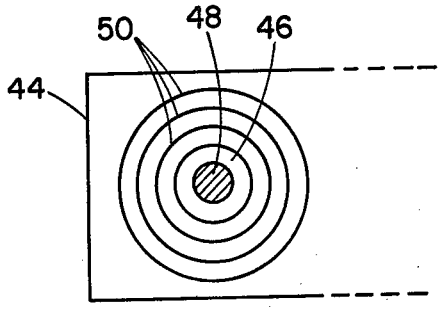
FIG. 4 is a plan view of an aperture electrode having a single aperture therein; adjacent

FIG. 4 shows schematically an aperture electrode 44 having a single aperture 46 through which passes electron beam 48. There are "electric field vectors" contiguous to aperture 46, which influence the contours of a beam spot projected by the electron gun, as shown by beam spot 52 of FIG. 4A. An electric field vector can be defined as a measure of the strength and direction of an electric field, in this case, a field about an aperture 46 of an electrode 44 having an electron beam 48 passing therethrough. An electric field vector can be visualized as a line whose direction is perpendicular to equipotential surfaces at the point of measurement, and wherein the strength is proportional to the increased difference in potential along that line divided by the incremental distance moved along that line. Electric field vectors can be conveniently represented by equipotential lines, as shown by lines 50, and should be considered as being oriented perpendicular to the equipotential surfaces. Any disordering of the electric field vectors as from interaction with the field vectors of a nearby aperture, for example, is also indicated by a disordering of the contours of the equipotential lines, as will be shown.

There being only one aperture 46 in aperture electrode 44, the electric field vectors are not in a state of disorder; consequently, equipotential lines 50 are shown as being symmetrical about aperture 46. As a result, the contour of a beam spot projected on the picture imaging screen of a color television picture tube is substantially undistorted and of a desired roundness, as indicated by the contour of beam spot 52 shown by FIG. 4A. The substantially undistorted state of beam spot 52 provides for optimum picture resolution.

Figure 4A:
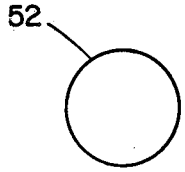
FIG. 4A is a view of a beam spot landing on a picture imaging plane showing the effect of the electrode of FIG. 4 on the contour of the beam spot.
Figure 5:
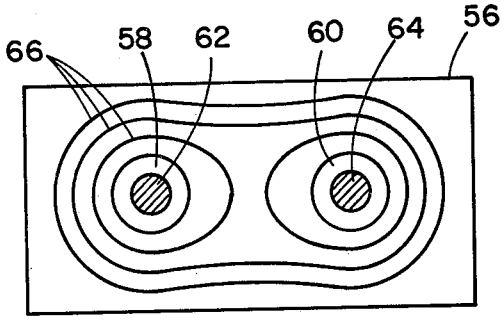
FIG. 5 is a plan view of an aperture electrode having two apertures therein.
Figure 5A:
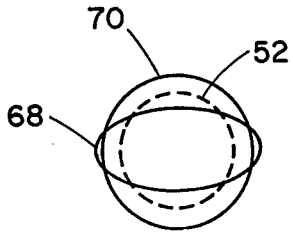
FIG. 5A shows the influence of the two apertures on beam spot contour.

FIG. 5 is a view similar to FIG. 4 except that the aperture electrode 56 has two apertures 58 and 60 therethrough in lieu of one, for passage of beams 62 and 64, respectively. Beams 62 and 64 are subject to a first-order aberration attributable to aperture electrode 56 having two apertures, resulting in the interactive coalescing of the electric field vectors contiguous to aperture 58 with the electric field vectors contiguous to adjacent aperture 60. This coalescing of the electric field vectors is indicated schematically by the equipotential lines 66, which indicate that the electric field vectors contiguous to each aperture are mutually attracted and conjoined. The result of the coalescing of electric field vectors indicated by equipotential lines 66 is shown by the ellipticizing in a horizontal plane of the contour of beam spot 68 shown by FIG. 5A. (The contour of beam spot 52 shown by FIG. 4A represented as being substantially undistorted for optimum picture resolution, is also indicated in FIG. 5A for comparison purposes.) It should be noted that beam spot 68 actually comprises two beam spots projected by beams 62 and 64, and which are caused to be superimposed by the converging means of the television receiver system, as is well-known in the art. All beam spots shown hereafter as single spots should be considered as comprising the projection of at least two superimposed electron beams on the picture imaging plane.

The elliptical distortion of beam spot 68 may be termed a "first-order aberration" which has the effect of astigmatizing the beam spot 68, causing the distortion indicated. It should be noted, however, that the elliptical spot 68 as shown does not appear on the screen; rather, the effect appears on the screen in the form of a larger spot, resulting in turn from a necessary correction of the beam spot to compensate for the ellipticity resulting from the first-order aberration. Whereas the original beam spot size is as indicated by 52, in correcting for the ellipticity indicated by the contour of beam spot 68, it is necessary to adjust the focus of the electron gun or guns to enlarge the beam spot as shown by spot 70, with a consequent loss in resolution.

Figure 6:
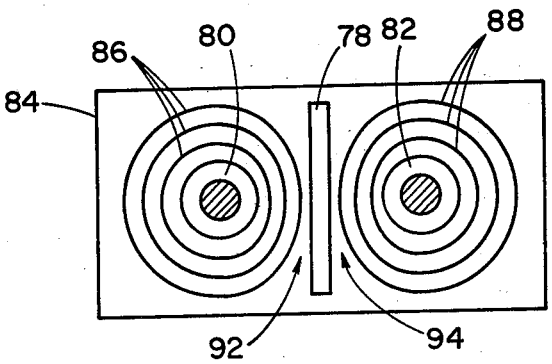
FIG. 6 is a plan vieww of an aperture electrode having two apertures mutually shielded; adjacent
Figure 6A:
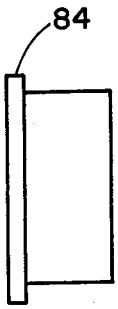
Figure 6B:
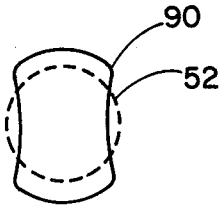
FIG. 6B shows the influence of the shielding means on beam spot contour.

An aspect of an improved shielding means according to the invention is shown by FIG. 6. The improvement comprises shielding means 78 interposed between apertures 80 and 82 of aperture electrode 84. As shown by FIG. 6A which is an end view of aperture electrode 84, the shielding means 78 interposed between apertures 80 and 82 comprises wall means attached to electrode 84. Wall means 78, shown as being rectangular by FIG. 6A, is oriented substantially perpendicular to the plane of electrode 84. Wall means 78 is effective to mutually shield apertures 80 and 82 and isolate the electric field vectors indicated schematically by the equipotential lines 86 and 88. As a result of the isolation of the electric field vectors, the aforedescribed first-order aberration, which results in the astigmatizing and consequent distortion of the beam spots, as indicated by beam spot 68 is ameliorated.

Wall means 78, however, while ameliorating the aforedescribed first-order aberration, introduces higher-order aberrations. The higher-order aberrations are due to a disordering of the electric field vectors resulting in forms of beam spot distortion other than astigmatic. The effect of this higher-order aberration is indicated by the distorted contour of beam spot 90. In comparison to substantially undistorted beam spot 52, beam spot 90 resembles an asymmetrical ellipse whose major axis is oriented vertically, and which has concave sides. This asymmetrical ellipticity distortion of beam spot 90 is as detrimental to optimum picture resolution as is the aforedescribed elliptically distorted beam spot 68. The higher-order aberrations resulting in the distorted contours of beam spot 90 are due to a disordering of the electric field vectors as schematically indicated by the compressed contour of the equipotential lines 86 and 88 in areas 92 and 94 adjacent wall means 78.

Figure 7:
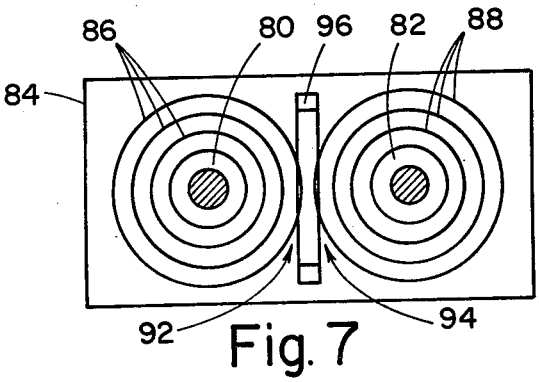
FIG. 7 is a plan view of an aperture electrode having shielding means with an additional shielding provision according to the invention; adjacent
Figure 7A:
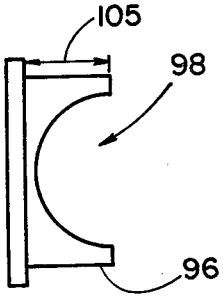
Figure 7B:
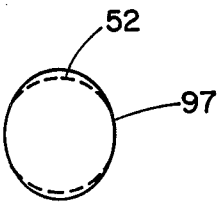
FIG. 7B shows the influence of the provision on beam spot contour.

The improvement according to the invention further comprises a configuration of the wall means wherein a section of the wall means comprises a cut-one. This configuration is shown by FIG. 7, and FIG. 7A which comprises an end view of electrode 84, wherein wall means 96 has a cut-out 98 shaped so as to be effective to re-order the electric field vectors and ameliorate the affect of the higher-order aberrations. This re-ordering is shown by FIG. 7, wherein equipotential lines 86 and 88, which represent schematically the electric field vectors about apertures 80 and 82 are shown as being symmetrical in areas 92 and 94 adjacent to wall means 96. The symmetricality of equipotential lines 86 and 88 will be noted as being consonant with the symmetricality of equipotential lines 50 of FIG. 4. The effect of the improvement according to the invention is shown by beam spot 97 of FIG. 7B which is shown as being in a substantially undistorted state.

Cut-out 98, which, as noted, is shaped so as to be effective to re-order the electric field vectors, is shown as comprising an in-curving cut-out comprising at least a third of the area of wall means 96. The cut-out according to the invention is not limited to the configuration of in-curving cut-out 98; the cut-out could as well comprise a circular cut-out in lieu of the parabola-shape, a cut-out in the shape of a square, or even a suitably shaped perforation in wall means 96, and still be effective to re-order the electric field vectors according to the invention.

Figure 8:
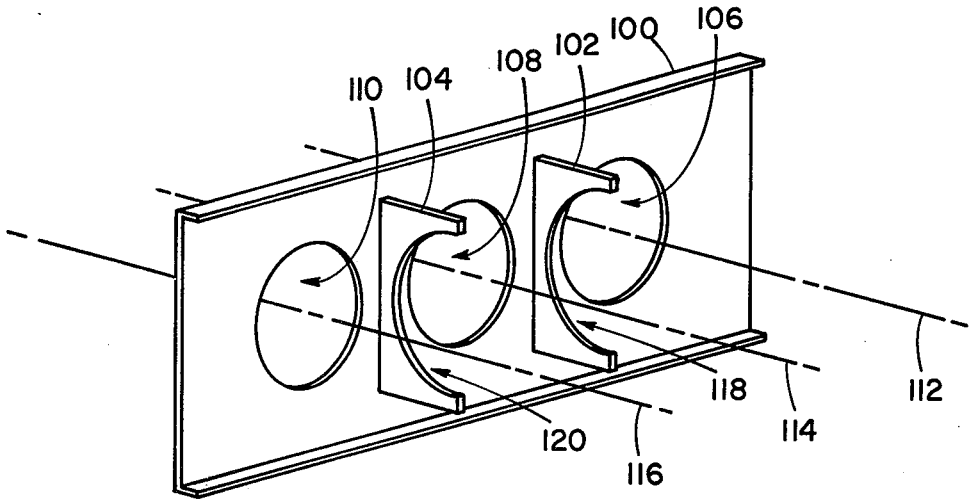
FIG. 8 is a view in perspective of an aperture electrode for a three-beam unitized electron gun showing the preferred embodiment of the shielding means according to the invention.

Application of the improvement according to the invention to an aperture electrode for a three-beam unitized in-line electron gun is shown by FIG. 8. The improvement comprises shielding means 102 and 104 interposed between apertures 106, 108 and 110 for the passage of electron beams 112, 114 and 116, respectively. Shielding means 102 and 104 according to the invention comprise wall means attached to electrode 100 and oriented substantially perpendicular to the plane of electrode 100. The shielding means 102 and 104 are effective to mutually shield apertures 106, 108, and 110 and isolate the electric field vectors to ameliorate the aforedescribed first order aberration which results in the astigmatizing and consequent distortion of the beam spots. The improvement further comprises a configuration of the wall means comprising cut-outs 118 and 120 in shielding means 102 and 104, respectively, the cut-outs being so shaped as to be effective to re-order the electric field vectors and ameliorate the effect of higher-order aberrations. It is to be noted that the dimensions, configurations, and proportions of shielding means 102 and 104 of FIG. 8, as illustrated, are not to be considered in any way limiting; the parameters can be sized, contoured, or otherwise adapted to provide necessary shielding for aperture electrodes, all according to the teachings of the invention.

The shielding means according to the invention can be fabricated from the same material as commonly used for gun electrodes; for example, an austenitic grade of stainless steel designated as AISI type 305, and having a thickness of 10 mils. The height of the wall means, indicated by arrow 105 of FIG. 7, is not critical; the height could be in the range of 20–200 mils, for example. The heigth may be limited, however by the fact that the electrodes of an electron gun may be required to lie in relatively close proximity.

Figure 9:
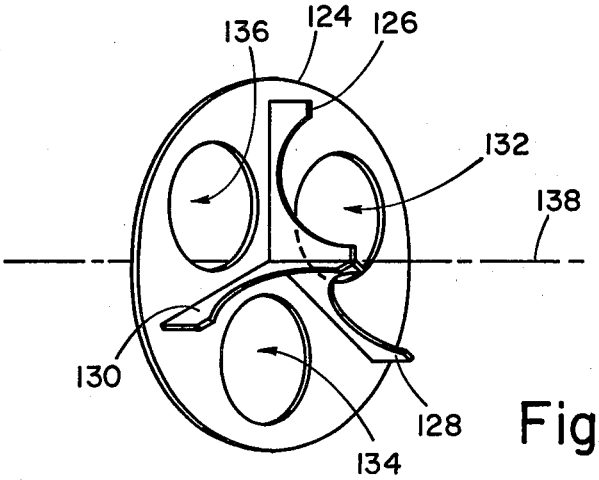
FIG. 9 is a view in perspectivve of another embodiment of the invention for an aperture electrode of a delta-configured electron gun.

FIG. 9 shows the shielding means according to the invention applied to an aperture electrode 124 for use in a three-beam, unitized electron gun of delta, or triangular configuration. In this embodiment of the invention, shielding means 126, 128 and 130 are shown as comprising wall means effective to mutually shield apertures 132, 134 and 136 and isolate the electric field vectors to ameliorate first-order aberrations, and further comprising a cut-out in the wall means to ameliorate the effect of higher-order aberrations according to the invention. In this embodiment of the invention, shielding means 126, 128 and 130 are shown as intersecting on the axis 138 of disc-type aperture electrode 124, and extending radially outward to provide shielding for beam apertures 132, 134 and 136.

Figure 10:
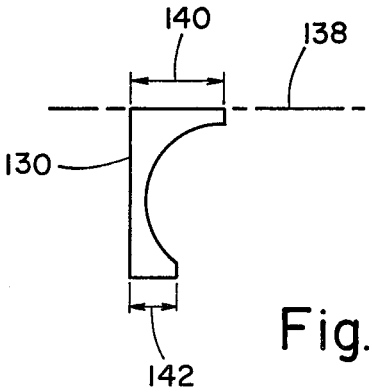
FIG. 10 is a plan view of one section of the embodiment shown by FIG. 9.

As illustrated in added detail in FIG. 10, the height of the shielding means 126, 128 and 130 may be greater at the ends that intersect at axis 138 than their height at the ends nearest the periphery of the electrode 124. This difference is indicated for shielding means 130 by arrows 140 and 142. The purpose of this disparity in height is that less inter-aperture shielding is required in the peripheral zones of electrode 124 because of its circular geometry. The difference in height described may be in the ratio of 2 to 1, for example. This ratio, and any other dimensions or proportions shown or described, are not to be considered as limiting, but as exemplary only. The actual parameters depend upon the requirements of a particular electron gun in which the invention is to be beneficially employed, and the selection of the proper parameters for any specific application is well within the purview of one skilled in the art.

This invention has many applications, one of which is an advantageous association with a cathode ray tube having a unique unitized in-line electron gun as disclosed in U.S. Pat. No. 3,995,194, assigned to the same assignee as the present application. The gun comprises associated cathode means and grid means for producing a beam of electrons, and a novel focus lens means. The focus lens means receives electrons from the cathode means and a predetermined pattern of voltages form power supply 30, shown by FIG. 3. The lens comprises at least three electrodes for establishing a single, continuous electrostatic focusing field characterized by having an axial potential distribution which, at all times during tube operation, decreases smoothly and monotonically from a relatively intermediate potential to a relatively low potential spatially located at a lens intermediate position, and then increases smoothly, directly and monotonically from said relatively low potential to a relatively high potential.

While particular embodiments of the invention have been shown and described, it will be obvious to those skilled in the art that changes and modificaitons may be made without departing from the invention in its broader aspects, and, therefore, the aim in the appended claims is to cover all such changes and modifications as falling within the true spirit and scope of the invention.

I claim:

1. In a television cathode ray picture tube having a plural-beam electron gun for projecting in superimposition on the picture imaging screen of said tube at least two electron beam spot, said gun including at least one aperture electrode having an aperture for passage therethrough of each of said beams, said beams being subject to a first-order aberration attributable to said aperture electrode resulting in the astigmatizing and consequent distortion of said beam spots due to the coalescing of electric field vectors contiguous to each aperture with the electric field vectors of at least one adjacent aperture, an improvement comprising shielding means interposed between said apertures comprising wall means, said wall means being effective to mutually shield said apertures and isolate said electric field vectors to ameliorate said first-order aberration, said wall means introducing, however, higher-order aberrations due to a disordering of said electric field vectors resulting in forms of beam spot distortion other than astigmatic, said improvement further comprising a configuration of said wall means wherein a section of said wall means comprises an in-curving cut-out comprising at least a third of the area of said wall means, said cut-out being symmetrical about a plane defined by the axes of said apertures and so configured that there is greater shielding off-plane than on-plane, said cut-out being effective to re-order said electric field vectors and ameliorate the effect of said higher-order aberrations whereby said gun is enabled to project substantially undistorted beam spots.

2. In a television cathode ray picture tube having a three-beam unitized, in-line electron gun for projecting in superimposition on the picture imaging screen of said tube three electron beam spots, said gun including at least one aperture electrode having three apertures for passage therethrough of said beams, said electron gun including focus lens means comprising at least three electrodes for establishing a single, continuous electrostatic focusing field characterized by having an axial potential distribution which, at all times during tube operation, decreases smoothly and monotonically from a relatively intermediate potential to a relatively low potential spatially located at a lens intermediate position, and then increases smoothly, directly and monotonically from said relatively low potential to a relatively high potential, said beams of said gun being subject to a first-order aberration attributable to said aperture electrode resulting in the astigmatizing and consequent distortion of said beam spots due to the coalescing of electric field vectors contiguous to each aperture with the electric field vectors of at least one adjacent aperture, an improvement comprising shielding means interposed between said apertures comprising wall means, said wall means being effective to mutually shield said apertures and isolate said electric field vectors to ameliorate said first-order aberration, said wall means introducing, however, higher-order aberrations due to a disordering of said electric field vectors resulting in forms of beam spot distortion other than astigmatic, said improvement further comprising a configuration of said wall means wherein a section of said wall means comprises an in-curving cut-out comprising at least a third of the area of said wall means, said cut-out being symmetrical about a plane defined by the axis of said aperture and so configured that there is greater shielding off-plane than on-plane, said cut-out being effective to re-order said electric field vectors and ameliorate the effect of said higher-order aberrations whereby said gun is enabled to project substantially undistorted beam spots.

3. In a television cathode ray picture tube having a plural-beam electron gun for projecting in superimposition on the picture imaging screen of said tube at least two electron beam spots, said gun including at least one aperture electrode having an aperture for passage therethrough of each of said beams, said beams being subject to a first-order aberration attributable to said aperture electrode resulting in the astigmatizing and consequent distortion of said beam spots due o the coalescing of electric field vectors contiguous to each aperture with the electric field vectors of at least one adjacent aperture, an improvement comprising shielding means interposed between said apertures comprising wall means, said wall means being effective to mutually shield said apertures and isolate said electric field vectors to ameliorate said first-order aberration, said wall means introducing, however, higher-order aberrations due to a disordering of said electric field vectors resulting in forms of beam spot distortion other than astigmatic, said improvement further comprising a configuration of said wall means wherein a section of said wall means comprises a cut-out, said cut-out being symmetrical about a plane defined by the axes of said apertures and so configured that there is greater shielding off-plane than on-plane, said cut-out being effective to reorder said electric field vectors and ameliorate the effect of said higher-order aberrations whereby said gun is enabled to project substantially undistorted beam spots.

* * * * *